United States Patent [19]

Rogers

[11] 3,978,825

[45] Sept. 7, 1976

[54] ROTARY INTERNAL COMBUSTION ENGINE

[76] Inventor: Paul Rogers, 451 SW. Primrose, Portland, Oreg. 97219

[22] Filed: Oct. 29, 1974

[21] Appl. No.: 518,584

Related U.S. Application Data

[63] Continuation-in-part of Ser. No. 370,821, July 13, 1973, abandoned.

[52] U.S. Cl. ..... 123/8.45; 418/97; 418/244

[51] Int. Cl.[2] ..... F02B 53/00

[58] Field of Search ..... 123/8.45; 418/97, 122, 418/139, 244, 246

[56] References Cited

UNITED STATES PATENTS

| | | | |
|---|---|---|---|
| 1,174,632 | 3/1916 | Snyder | 123/8.45 |
| 2,055,137 | 9/1936 | Sherman | 418/244 X |
| 2,744,505 | 5/1956 | Sherman | 123/8.45 |
| 3,289,652 | 12/1966 | Muller | 418/139 X |
| 3,474,766 | 10/1969 | Smith | 123/8.45 |
| 3,664,778 | 5/1972 | Nilsson | 418/122 X |
| 3,771,500 | 11/1973 | Shakiba | 123/8.45 X |

FOREIGN PATENTS OR APPLICATIONS

| | | | |
|---|---|---|---|
| 635,754 | 9/1936 | Germany | 123/8.45 |
| 175,764 | 6/1935 | Switzerland | 123/8.45 |

*Primary Examiner*—Carlton R. Croyle
*Assistant Examiner*—Michael Koczo, Jr.
*Attorney, Agent, or Firm*—Oliver D. Olson

[57] ABSTRACT

A tubular housing having a circular inner surface provided with a plurality of recesses receiving pistons movable pivotally between a position fully retracted in the recesses and a position projecting radially inwardly from the housing. A rotor is rotatably supported centrally in the housing and has peripheral cavities equal in number to the number of pistons in the housing and capable of receiving the pistons in portions of their pivotal movement to perform with the pistons functions of fuel intake, fuel compression, firing and exhaust. The housing has fuel intake ports, spark plugs and exhaust outlet ports operable in conjunction with the rotor and pistons to perform the engine functions. The pistons are moved inwardly into the cavities during certain operations of the engine by levers operably connected to the rotor. The engine has coolant and oil circulating structure to cool it and to lubricate it. In addition, seals are associated with the pistons and rotor to prevent the escape of power.

3 Claims, 13 Drawing Figures

FIG. 7
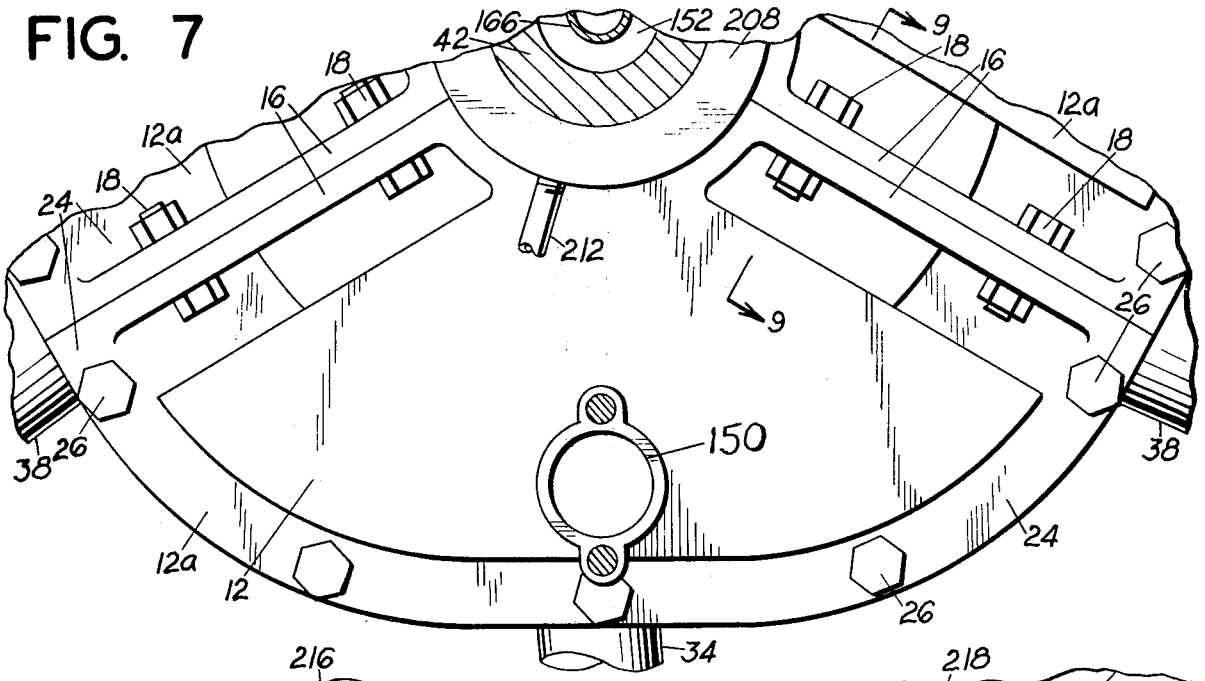
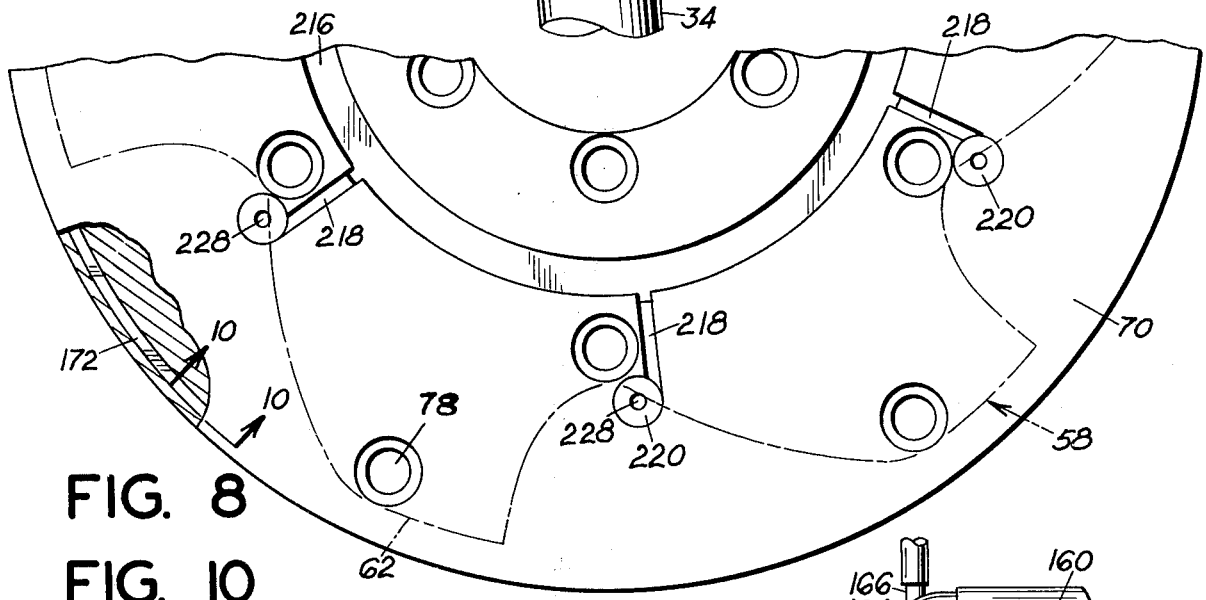
FIG. 8
FIG. 10
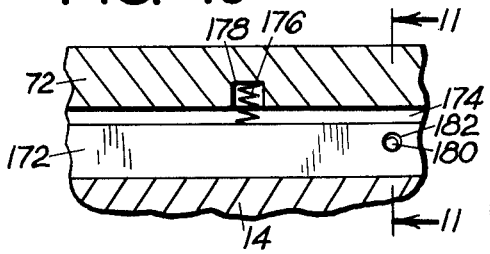
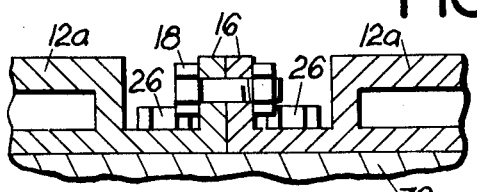
FIG. 9
FIG. 1
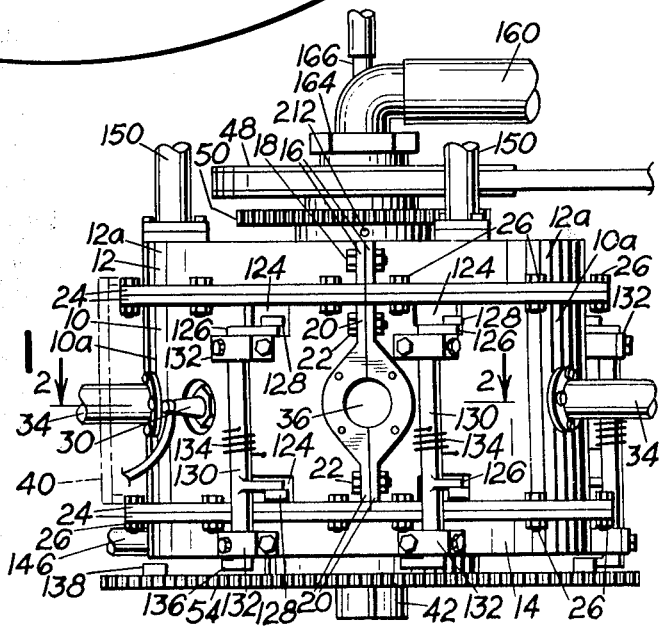

FIG. 4
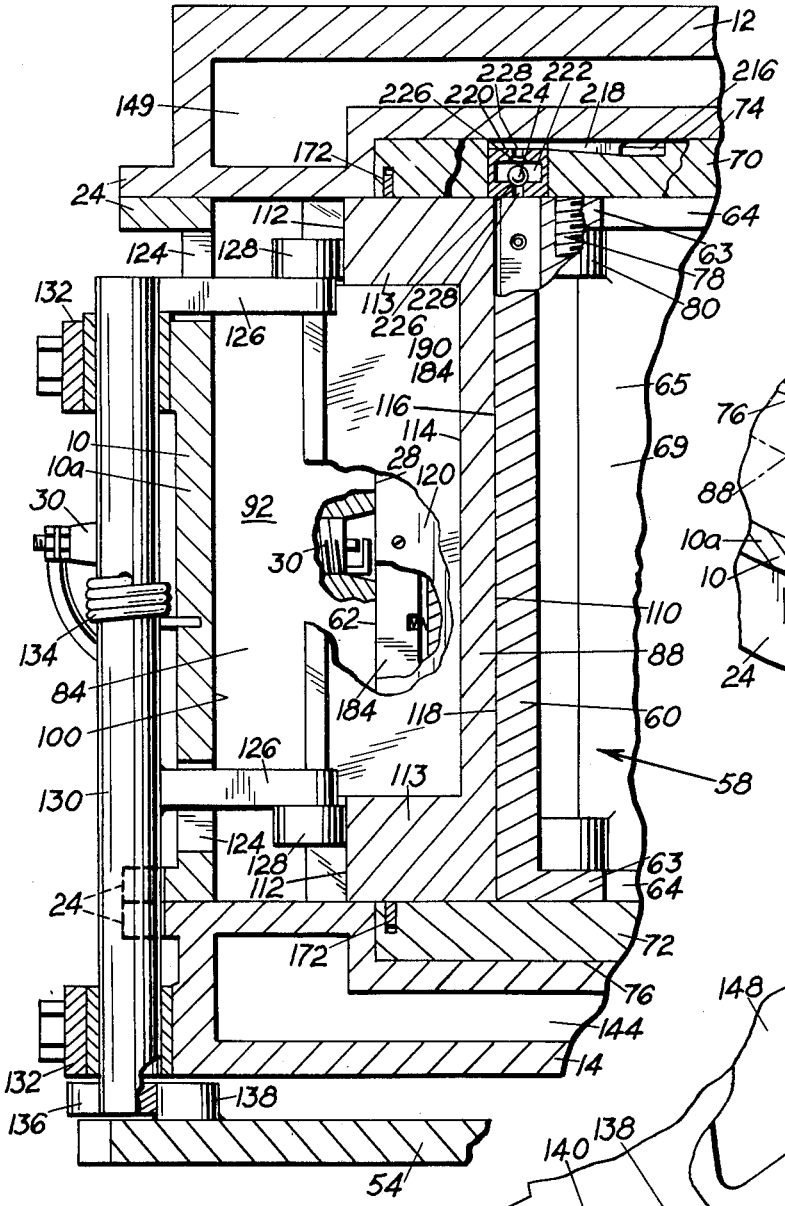
FIG. 13
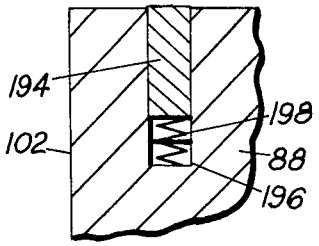
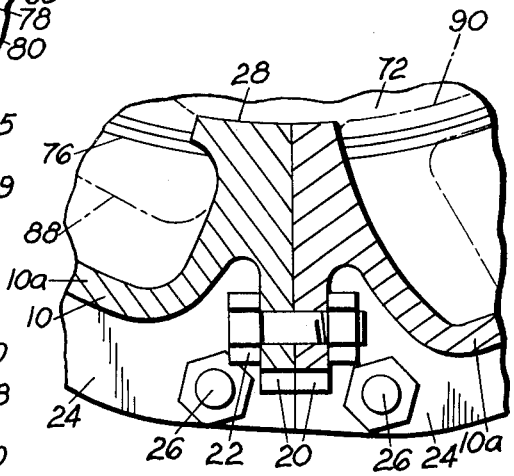
FIG. 6
FIG. 5
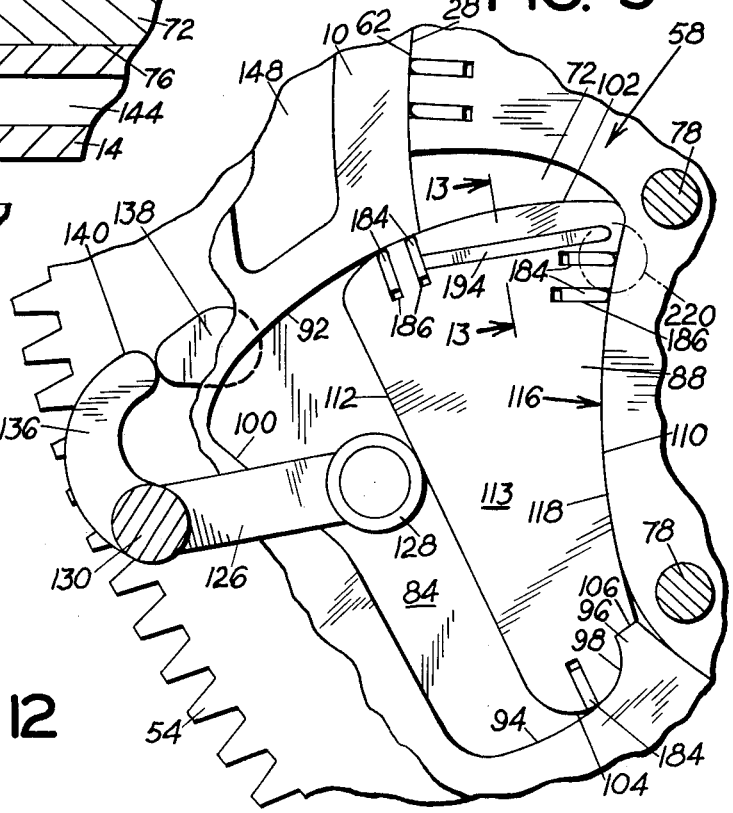
FIG. 11
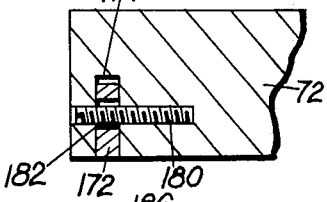
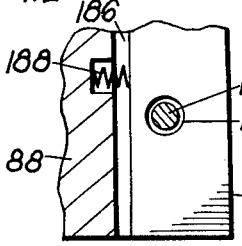
FIG. 12

ROTARY INTERNAL COMBUSTION ENGINE

CROSS REFERENCE TO RELATED APPLICATION

This is a continuation-in-part of my earlier application Ser. No. 370,821 filed July 13, 1973 and now abandoned.

BACKGROUND OF THE INVENTION

This invention relates to new and useful improvements in rotary internal combustion engines.

Rotary Internal combustion engines have heretofore been proposed in an attempt to produce a more efficient source of power than the piston type engine which is rendered inefficient by the conversion of reciprocating type of movement into rotary movement. Such prior rotary engines have utilized vane type structures or the like that require a great number of moving parts to provide the required chambers for fuel intake, compression, firing and exhaust. Most prior structures have proved to be inoperative in the practical sense in view of such use of an excessive number of parts.

SUMMARY OF THE INVENTION

According to the invention, a principle in a rotary internal combustion engine is utilized wherein pistons are disposed in recesses in an outer circular housing and are arranged to cooperate with cavities in a central rotor in an arrangement wherein the efficiency of a rotary engine is maintained while at the same time a minimum number of parts is employed, thus reducing the cost of manufacture and maintenance to a practical point.

A more particular object of the invention is to provide a rotary internal combustion engine wherein the pistons have pivotal support in the recesses in the housing and are operative to pivot in and out in cooperation with the rotor cavities to accomplish the functions of fuel intake, compression, firing and exhaust.

Another object of the invention is to provide a piston arrangement of the type described associated with levers pivotally mounted on the housing and arranged by driving engagement from an output from the rotor to move the pistons inwardly at the selected time to accomplish such engine functions, such levers fixedly holding the pistons in the cavities during the firing function such that the pistons form a solid base for the combustion.

Still another object of the invention is to provide a structure having a novel arrangement of water passageways for cooling and also having novel sealing and lubricating means.

The invention will be better understood and additional objects and advantages will become apparent from the following description taken in connection with the accompanying drawings.

BRIEF DESCRIPTION OF THE DRAWINGS

FIG. 1 is a side elevational view of the present engine, this view being in reduced scale relative to the other views;

FIGS. 3 and 4 are fragmentary sectional views taken on the lines 3—3 and 4—4 of FIG. 2, respectively;

FIGS. 5, 6, 7 and 8 are fragmentary sectional views taken on the lines 5—5, 6—6, 7—7 and 8—8 of FIG. 3, respectively;

FIG. 9 is a fragmentary sectional view taken on the line 9—9 of FIG. 7;

FIG. 10 is a fragmentary sectional view taken on the line 10—10 of FIG. 8;

FIG. 11 is a fragmentary sectional view taken on the line 11—11 of FIG. 10;

FIG. 12 is a fragmentary sectional view taken on the line 12—12 of FIG. 2; and FIG. 13 is a fragmentary sectional view taken on line 13—13 of FIG. 5.

DETAILED DESCRIPTION OF A PREFERRED EMBODIMENT

Figure 2:
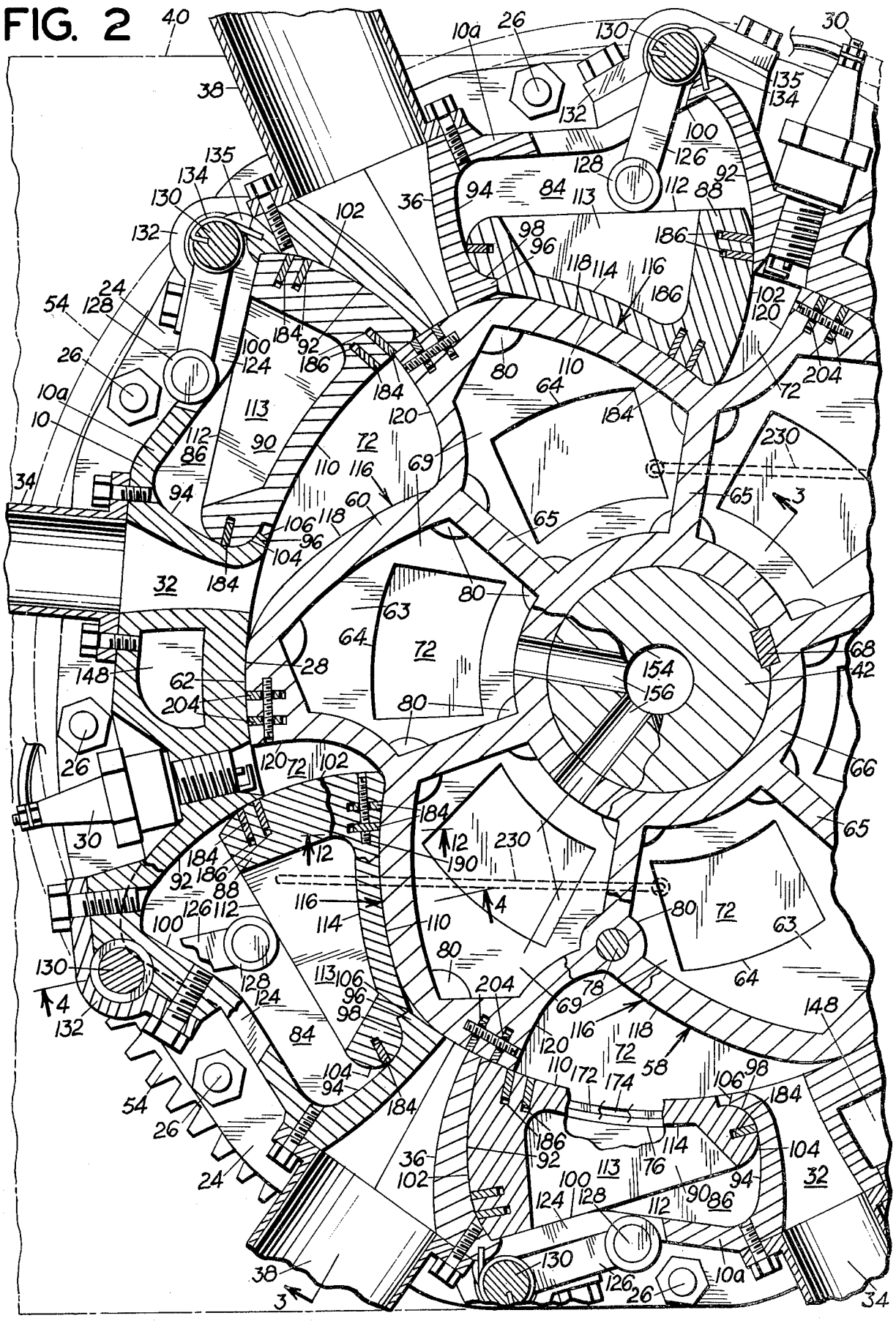
FIG. 2 is a fragmentary sectional view taken on the line 2—2 of FIG. 1.

With particular reference first to FIGS. 1–4, the engine of the instant invention comprises in general a tubular housing 10, an upper cover 12 and a lower cover 14. Lower cover 14 is preferably of one piece but the housing 10 and cover 12 are formed of a plurality of identical arcuate sections **10*a* and 12*a*, respectively. With reference to FIGS. 1, 7 and 9, the sections 12*a* of the cover 12 have radially extending top flanges 16 for removable connection of such segments together, as by bolts 18. Housing sections 10a have side flanges 20, FIGS. 1, 3 and 6, for removable connection of such sections together, as by bolts 22. Further yet, each of the members 10, 12 and 14 has horizontal side flanges 24, FIGS. 1, 2 and 3 for removably connecting such members together, as by bolts 26.**

The housing 10 as formed by the sections 10a has a circular inner wall surface 28, best seen in FIG. 2, and each of the sections **10*a* has a spark plug 30 mounted therein and an adjacent exhaust port 32 having suitable connection to an exhaust manifold 34. A fuel intake port 36 is formed in each junction between the sections 10*a* and such intake is associated with a fuel intake manifold 38. Details of wiring for the spark plugs and details of structure for the exhaust and intake manifolds are not shown since such is common structure well known in the art. A mounting bracket 40, FIGS. 1 and 3,** supports the engine as necessary.

Figure 3:
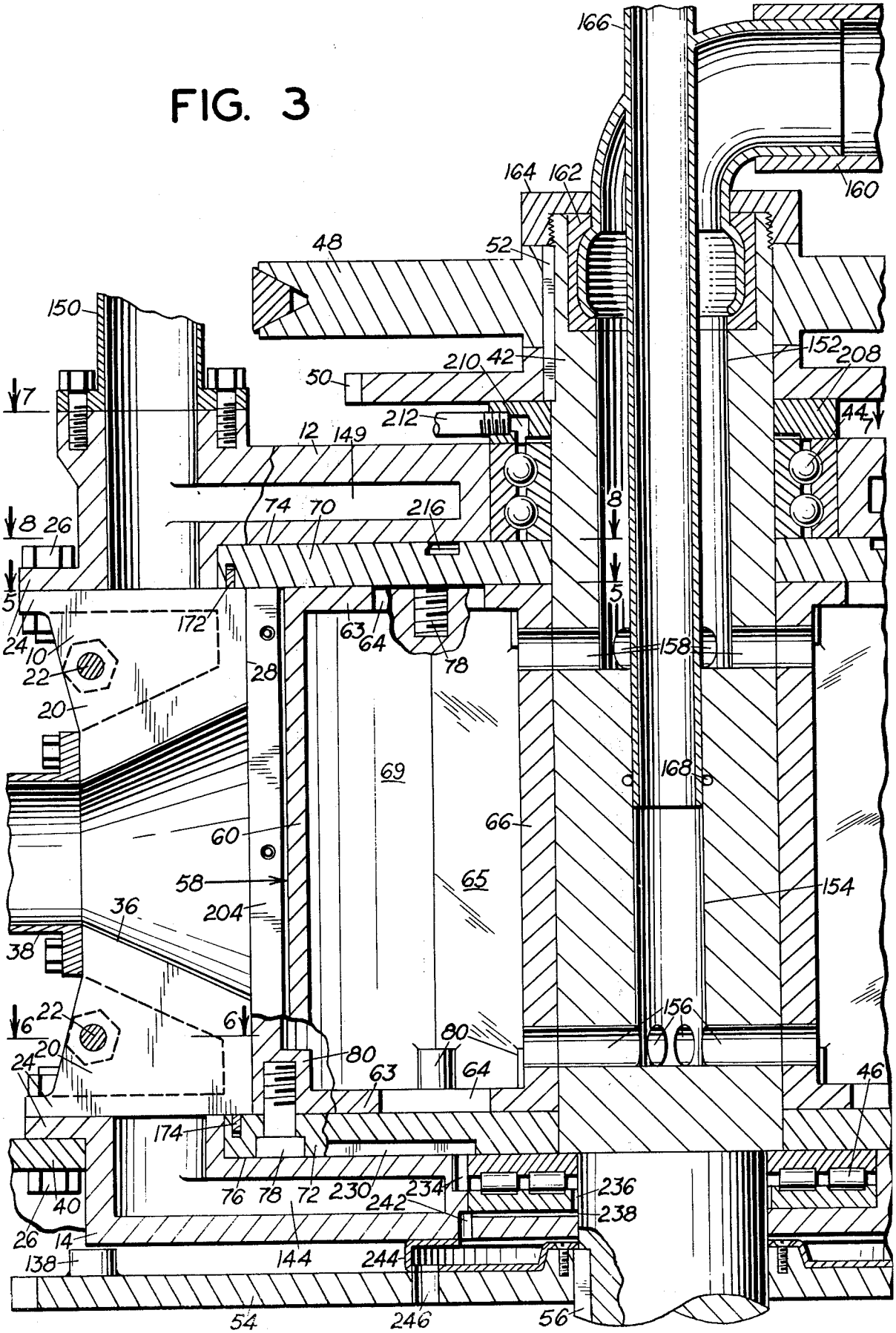

A shaft 42 projects centrally through the housing and as best seen in FIG. 3, this shaft has journaled engagement in an upper bearing 44 mounted in the upper cover 12 and a thrust bearing 46 mounted in the lower cover 14. This shaft projects from the upper end of the housing and has an accessory pulley 48 and a timing gear 50 keyed thereto by a key connection 52. The lower end of the shaft projects from the lower end of the housing for connection to means to be driven, such as a transmission, not shown, and this projecting end has a starter gear 54 keyed thereto by a key connection 56.

Disposed centrally within the housing is a rotor 58, FIGS. 2–5, and this rotor has an outer circumferential wall 60 with an outer or peripheral surface 62 operating closely adjacent to the inner wall surface 28 of the housing. Wall 60 is integral with top and bottom walls 63 of the rotor having openings 64 therein and also integral with radial webs 65 extending from a hub portion 66 secured on the shaft 42 for rotation therewith by a key connection 68. The web arrangement of the rotor provides upright hollow areas 69 to make a lightweight structure.

Rotor 58 extends the full height of the housing section 10 and in addition has upper and lower end walls or plates 70 and 72, respectively, FIGS. 3, 4 and 8 disposed in respective recesses 74 and 76 in upper and lower covers 12 and 14. End walls 70 and 72 centrally receive the shaft, and their diameters are such that their outer peripheral edges are radially outward of the inner wall surface 28 of the housing. Walls 70 and 72 are secured integrally to the rotor by means of countersunk screws 78, FIG. 3, projecting through the walls and having threaded engagement in screw bosses 80, also seen in FIG. 2, formed at the top and bottom of the rotor at web junctions.

With particular reference again to FIGS. 2, 3 and 4, power drive functions of the engine are accomplished by cooperating structure between the housing and rotor in association with the fuel intake ports, spark plugs, and exhaust ports. To accomplish such function, each section 10a of the housing is provided with an inwardly facing first piston recess 84 between a fuel intake port 36 and the spark plug 30 in the section and an inwardly facing second piston recess 86 of identical shape between the exhaust outlet 32 in such section and the next fuel intake port 36. Recesses 84 and 86 have pistons 88 and 90, respectively therein of identical shape. Recesses 84 and 86 have opposite end wall surfaces 92 and 94 that extend somewhat radially of the housing. End wall 92 is gently concaved throughout its length. Wall 94 has an inner end projection 96 provided with a curved surface 98 on its side that faces the exterior of the housing. Recesses 84 and 86 have a depth to allow full retraction of the pistons therein and have an outer wall portion 100 against which a portion of the pistons is arranged to abut in their retracted position.

Pistons 88 and 90 extend fully from top to bottom of their recesses. They have a convex front face 102 of a radius identical to the curvature of end surface 92 of the recesses.

The other or rearward end 104 of the pistons is rounded and has a radius of curvature identical to that of the curved portion 98 of the recesses so that the pistons can pivot into and out of the recesses between two extreme positions illustrated by the pair of pistons 88 and 90 at the left side of FIG. 2. In such pivotal movement of the pistons, front surfaces 102 thereof slide freely along and closely adjacent to recess surfaces 92. An offset edge 106 is provided at the inner portion of piston ends 104, and this edge has abutment against the end of projection 96 in the fully extended position of the piston.

The side surface 110 of each piston that faces inwardly has a concaved curvature, and the other side 112, namely, the outwardly directed side, is straight. The pistons have top and bottom end walls 113 and outwardly facing recesses 114 intermediate their ends to reduce their weight.

The outer wall 60 of the rotor has cavities 116 therein equal in number to the number of piston recesses in the housing. Each of the cavities 116 has a first wall portion 118 that curves inwardly from the surface 62 at a radius identical to the radius of curvature of side 110 of the pistons whereby as seen by the positioning of piston 88 at the left side in FIG. 2, surface 110 is adapted to have contoured engagement throughout substantially its full length with the cavity surface 118. Surface 118 joins at its forward end with an outwardly extending curved surface 120 which forms the driving surface on the rotor.

In certain phases of operation of the present engine, as will be more apparent hereinafter, it is necessary that the pistons be driven inwardly into the cavities 116. For this purpose, each of the outer defining walls of the housing recesses 84 and 86 has an opening 124, and a pair of lever arms 126 project through each of these openings and have engagement with the outer side 112 of the pistons. Engagement of the lever arms with such pistons is by means of rollers 128 on the tops and bottoms of the arms. Each pair of lever arms 126 extends integrally from an upright shaft 130 having journaled support in upper and lower bearings 132 secured respectively to the exterior surface of the housing 10 and lower cover 14. These shafts are urged clockwise, as viewed in FIGS. 2 and 5, by a torsion spring 134 having one end secured to the shaft and the other end secured to the housing. The shafts are normally rotatable under the action of the spring to a retracted position of the arms wherein the pistons are capable of moving into their recesses in the housing, a stop 135 being integral with each shaft and being arranged to abut against the housing 10 to limit rotation of the shafts under the action of the springs.

Shafts 130 have an actuating finger 136, FIGS. 4 and 5, at the lower end thereof in the path of a plurality of projections 138 on the top surface of flywheel 54, and the arrangement is such that as the projections 138 engage the actuating fingers 136, the shafts 130 and consequently the arms 126 are driven counterclockwise, FIG. 2, to move the pistons into the cavities 116. Actuating fingers 136 have a rounded end 140 which abuts the projections 138 to smoothly move the lever arms into the cavities, the projections 138 also being rounded at their points of engagement by the fingers for minimum wear and shock to the parts.

Both the housing 10 and the rotor 58 have cooling means for the circulation of coolant. In the housing portion, the lower cover 14 has an annular passageway 144, FIGS. 3 and 4, having an inlet conduit 146, FIG. 1, communicating therewith. The housing has an upright passageway 148, FIG. 2, between each spark plug and exhaust port, and these upright passageways communicate at their lower ends with the annular passageway 144 and at their upper ends with an annular passageway 149 formed in the assembly of the top cover sections **12*a*. Each of the sections 12*a* of the cover 12 has an outlet conduit 150 from the passageway 149, and the inlet conduit 146 and the outlet conduits 150** have circulating relation with a radiator or the like, not shown, of the vehicle.

The cooling means in the rotor comprises a first bore 152, FIG. 3, in the shaft extending from the upper end thereof to a point just below the top of the rotor and a second bore 154, also seen in FIG. 2, of lesser diameter than bore 152 and extending from the bottom of bore 152 to a point just above the bottom of the rotor. Radial passageways 156 extend between the lower end of bore 154 and the hollow areas 69 of the rotor, and radial passageways 158 extend between the bore 152 at the lower end thereof and the upper portions of the open areas of the rotor. A conduit 160 is connected into the upper end of bore 152 by a fitting 162 held in place by a cap 164 threadedly mounted at the top of the shaft. A smaller conduit 166 extends in a watertight fit through a wall of the conduit 160 and projects downwardly into bore 154. A seal 168 is disposed around the lower end of the conduit 166 to provide a liquid tight connection of the latter in the bore 154.

Conduits 166 and 160 have circulating association with a radiator or the like, and in the circulation of the coolant it enters through conduit 166 and then passes through the passageways 156 into the open areas 69 of the rotor and then discharges from the upper passageways 158 and out through the conduit 160.

Sealing means for containing the power is provided throughout the engine. First the upper and lower end walls 70 and 72 of the rotor, respectively, have an annular sealing member 172, FIGS. 3, 4, and 8, which face and engage adjacent surfaces of the housing and pistons. These sealing members are shown in detail in FIGS. 10 and 11 and comprise blade-like structures confined movably in slots 174 in the rotor. These slots are deeper than the parallel dimension of the sealing members, and a plurality of small compression springs 176 confined partly in recesses 178 in the end walls of the rotor urge the sealing members outwardly. The slots 174, being of greater dimension than the parallel dimension of the seals, allow the latter to float therein under the force of springs 176 whereby to adjust automatically for wear and irregular surfaces. Sealing members 172 are confined in the slots by cross pins 180 threadedly supported in place and passing through apertures 182 in the sealing members. Apertures 182 are enlarged relative to the pin 180 to allow the floating movement of the sealing members.

Each of the pistons also has vertical sealing members 184, FIG. 2, projecting from surfaces 102, 104 and 110. With reference also to the detail view of FIG. 12, sealing members 184 similar to sealing members 172 have floating outward biased movement in deepened slots 186 through the action of springs 188. These sealing members are held in place by retaining pins 190 projecting through enlarged apertures 192 in the sealing members.

Further yet, the top and bottom surfaces of the pistons are provided with radially extending sealing members 194, FIGS. 5 and 13, similarly confined in deepened slots 196 and urged outwardly by springs 198. These sealing members extend longitudinally between a sealing member 184 and a point closely adjacent to the inner side 110 of the piston.

With reference to FIG. 2, the rotor has vertical sealing members 204 forward of each cavity 116. These sealing members have floating engagement in deepened slots similar to the other sealing members just described.

Lubrication means are provided for oiling those surface areas that have wearing engagement, and for this purpose an oil inlet ring member 208, FIGS. 3 and 7, is disposed between the timing gear 50 and the top cover 12 and has a port 210 therein in communication with an oil inlet conduit 212 from a suitable pressured oil system, not shown. The port 210 has communication with the bearing 44 and oil passes down through this bearing to the top surface of rotor wall 70. From there the oil seeps along between the top of wall 70 and the upper wall of recess 74 and then down the outer vertical defining wall of the recess and also down to the horizontal overlapping portion of the wall 70 and the housing and pistons for lubricating these relatively moving parts.

The walls 118 and 120 of the cavities 116 are also lubricated, and for this purpose the upper surface of wall 70 is provided with an annular channel 216, FIGS. 3, 4 and 8, which picks up oil from the flow along the top surface of such wall. Radially extending channels 218 lead from the channel 216 to each cavity at about the juncture of surfaces 118 and 120 of cavities 116. Disposed at the ends of channels 218 are oil feed inserts 220 set in the wall 70 and having inner chambers 222 in which a ball valve 224 is confined and arranged for engagement with upper and lower seats 226. Inserts 220 have upper and lower ports 228 communicating with the chambers 222 from the seats 226, and as best seen in FIG. 8, the ports 228 are located just outwardly of the surface 118 of the cavities whereby oil moving through the insert will serve to lubricate the surfaces of the cavities 116. In the operation of the inserts, oil will flow thereto by centrifugal force and will fill the chambers 222, the ball valves 224 resting by gravity on the lower seat to stop downward oil flow. When a power stroke occurs in the engine and since the lower port is aligned with a cavity 116 there is sufficient pressure to raise the ball valves 224 and allow a small amount of oil to escape through the valve to the cavity wall surfaces. During this power function, the ball valves 224 raise up against the upper seat to prevent escape of power but seal immediately upon termination of the power function.

With reference to FIGS. 2 and 3, the lower surface of bottom wall 72 of the rotor has a pair of channels 230 extending somewhat tangentially to the hub portion but spaced therefrom for picking up oil that has seeped down between the outer edge of wall 72 and the vertical defining wall of recess 76. The inner ends of these channels communicate with ports 234 leading to the thrust bearing 46. This bearing is provided with an inner annular passageway 236 through which oil in the bearing escapes, and this passageway communicates with channels 238 in a washer 240 inset in the bottom cover 14. Channels 238 have communication by means of a space 242 therearound with an oil pickup pan 244 secured to the flywheel between the bottom cover 14 and the flywheel. Discharge of the oil from the container 244 to a sump or reservoir is by ports 246 in the container and the flywheel. The channels 230, being somewhat tangential to the rotor rather than radial, sweep angularly around the bottom defining wall of cover recess 76 and pick up oil on the surface and direct it into the ports 234. The lubrication means described provides oiling in the area between all the relatively moving surfaces to provide long life for the engine.

For the purpose of explaining the operation in functions of fuel intake, compression, firing and exhuast, reference is made to FIG. 2 and first to that cavity 116 of the rotor 58 disposed at the lowermost position in such figure, the direction or rotation of the rotor being clockwise. In such position of the rotor this cavity is disposed almost in aligned relation with a piston 90 in recess 86 and thus has been in communication with an exhaust outlet 32 wherein the by-products of combustion of a previous firing function in such cavity will have mostly escaped. Also, in this position of the cavity, the spring 134 on the associated shaft 130 holds the lever arm 126 is retracted position out of engagement with the piston and the latter will be held in its recess by the outer surface 62 of the rotor just forward of the cavity being referred to.

As the rotor moves to a point where the surface 120 of the cavity 116 referred to extends beyond the end 102 of the adjacent piston, a projection 138 on the flywheel will have moved into engagement with the actuating finger 136 of the associated shaft 130 and the piston will be driven inwardly by lever arms 126 to completely scavenge the cavity. At about this time, the surface 120 of the cavity comes into communication with fuel intake port 36 and a suction is provided in the cavity by its forward movement relative to the piston 90 therein. As fuel is taken into the cavity the piston retracts into the housing recess 86, because projection 138 will now have disengaged from actuating finger 136 and the piston will be retracted by the outward driving sliding movement of cavity wall surface 118 against piston surface 110.

As the cavity 116 approaches the spark plug area with its change of air-fuel mixture, a projection 138 again engages actuating finger 136 of the shaft 130 that is associated with the piston 88, whereby the piston is driven inwardly to compress the charge of fuel. At about this time the leading surface 120 arrives at the spark plug and a spark is emitted. The parts are synchronized such that the lever arms 126 hold the piston in against the wall surface 118 at firing whereupon the force of the combustion between surfaces 102 and 120 operates fully against the rotor. The actuating finger 136 at the piston 88 that has just fired will immediately disengage from its projection 138 whereupon the piston can be returned by the outward driving sliding movement of the cavity wall surface 118 against piston surface 110. During radially outward retracting movement of the piston 88, both ends of the piston retract into recess 84, insuring maintenance of a positive seal between the piston surface 110 and cavity wall 118 during expansion of the combustion gases. As the piston approaches full retraction, its radially outward edges 112 abut the rearward portion of the outer angular surface 100 of the recess 84 and the piston is caused to pivot counterclockwise (FIG. 2) about the central portion of the angular surface 100 to swing the rearward end 104 of the piston radially inward into the curved surface 98. The forward portion of the piston then completes its retraction into recess 84 by forward rotation of the rotor, until inner arcuate surface 110 of the piston lies in the circular plane of the inner surface 28 of the housing 10, as illustrated by the pistons at the top of FIG. 2.

Pistons 90 thus perform the steps of scavanging the cavities 116 of spent combustion gases to exhaust ports 32 and of evacuating the cavities 116 for drawing fresh fuel mixture into them from fuel intake ports 36. Pistons 88 perform the steps of fuel compression and firing in association with each registering cavity which, similar to the cavity initially described, will arrive with a fuel charge. Upon rotation of the rotor from the effects of the fuel combustion, the cavity after it leaves the spark plug area will move into communication with the exhaust port 32 at the left for the scavenging and fuel intake in association with the following piston in repeated functions identical to that described herein.

Thus, in the operation, each cavity will pick up a charge of fuel at an intake 36, have the charge compressed and fired at a piston 88, exhaust at the outlet 32, and then further exhaust and start the next cycle at the piston 90.

Since each cavity receives a firing function at each spark plug and since there are three spark plugs, 18 firing functions occur in one revolution of the rotor. This arrangement is only exemplary, however, and any number of the pairs of pistons 88 and 90 may be provided.

The engine of the instant invention has a minimum number of parts and is thus inexpensive to manufacture and maintain. It also has the advantage that the air-fuel mixture is somewhat preheated and thoroughly mixed prior to firing for more complete combustion and the discharge of less pollutants. The engine has the further advantage that the gases expand in a direction that is normal to the diameter of the rotor, thus most efficiently converting the pressure into mechanical energy.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A rotary internal combustion engine comprising:

a. a tubular stationary housing, b. the inner surface of the housing having at least one pair of circumferentially spaced recesses therein, c. the pair of recesses having associated therewith circumferentially spaced fuel intake means, spark emitting means and exhaust means, d. a rotor in said housing having an outer surface rotable closely adjacent said inner surface of said housing, e. said outer surface of the rotor having a plurality of circumferentially spaced rotor cavities therein each registrable with each recess in the housing during rotation of the rotor, each cavity having a forward driving surface extending inwardly from the outer surface of the rotor and a trailing surface extending rearwardly from the inner edge of the forward driving surface to the outer surface of the rotor, f. a piston in each recess movable freely at both of its ends radially between a position fully retracted in its recess and a position projecting radially inward into a registering rotor cavity, each piston having a front face arranged in sealed, sliding engagement with the front surface of its recess, the front face of the piston associated with one of the recesses defining with the forward driving surface of a registering cavity, when the piston is projected thereinto, a combustion chamber registering with the spark emitting means, and each piston having an inner surface which, when the piston is projected into a rotor cavity, is disposed at least at its forward end in sealed, sliding engagement with the trailing surface of said cavity throughout the air-fuel combustion and gas-expansion portions of the operating cycle of the engine, g. timed piston drive means associated with each piston and operable momentarily to move the piston in said one recess inwardly into a registering rotor cavity to effect compression of air-fuel mixture for combustion and thereafter to allow free outward movement of the piston into its recess, and operable momentarily to move the piston in the other recess of the pair inwardly into a registering rotor cavity to effect scavanging of combustion gases from said rotor cavity to the exhaust means and to effect evacuation of the rotor cavity for drawing air-fuel mixture thereinto from the fuel intake means and thereafter to allow free outward movement of the piston into its recess, and h. power output means connected to said rotor for rotation therewith.

2. The rotary internal combustion engine of claim 1 wherein the timed piston drive means includes driven means connected to and rotatable with said power output means exteriorly of said housing, a lever associated with each piston pivotally mounted intermediate its ends on said housing and having one end thereof disposed for abutting engagement with said piston on the side of the latter opposite the rotor, said lever being pivotally movable between an outer retracted position allowing said piston to retract into its recess and an inner position moving said piston from its recess into a registering rotor cavity, and a projection on said driven means arranged to engage the other end of said levers momentarily whereby to rotate said lever to its position of momentarily moving said piston from its recess into a registering rotor cavity.

3. The rotary internal combustion engine of claim 1 wherein said housing has at least three pairs of said recesses and pistons, said one piston of each pair being located between an exhaust means and a fuel intake means and said other piston of each pair being located between a fuel intake means and a spark emitting means, and wherein said rotor has a corresponding number of rotor cavities.

* * * * *